US006797930B2

(12) United States Patent
Kim

(10) Patent No.: US 6,797,930 B2
(45) Date of Patent: Sep. 28, 2004

(54) WALL-MOUNTED TYPE MICROWAVE OVEN

(75) Inventor: Min-Serk Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/225,344

(22) Filed: Aug. 22, 2002

(65) Prior Publication Data

US 2003/0218012 A1 Nov. 27, 2003

(30) Foreign Application Priority Data

May 23, 2002 (KR) ..... 2002-28760

(51) Int. Cl.[7] ..... H05B 6/80
(52) U.S. Cl. ..... 219/757; 126/273 A
(58) Field of Search ..... 219/757, 681, 219/756, 758, 391, 400; 126/273 A, 21 A, 299 D, 299 R, 21 R; 362/92

(56) References Cited

U.S. PATENT DOCUMENTS 3,356,008 A * 12/1967 Simpson et al. ..... 126/299 D
3,496,704 A * 2/1970 Bandlow ..... 96/138
4,418,261 A * 11/1983 Jailor et al. ..... 219/757
6,018,158 A * 1/2000 Kang ..... 219/757
6,291,809 B1 9/2001 Ha

FOREIGN PATENT DOCUMENTS

KR 9711181 * 7/1997

* cited by examiner

*Primary Examiner*—Quang T. Van
(74) *Attorney, Agent, or Firm*—Staas & Halsey LLP

(57) ABSTRACT

A wall-mounted type microwave oven includes a slide duct which is forwardly extendable from the microwave oven to guide exhaust gas generated from an area in front of the microwave oven. The slide duct comprises a pair of guide plates, an exhaust path and an auxiliary exhaust fan. The exhaust gas is efficiently sucked into the slide duct and introduced into the microwave oven body where the slide duct is extended forward.

7 Claims, 6 Drawing Sheets

WALL-MOUNTED TYPE MICROWAVE OVEN

CROSS-REFERENCE TO RELATED APPLICATIONS

This application claims the benefit of Korean Patent Application No. 2002-28760 filed on May 23, 2002, in the Korean Industrial Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven having a slide duct which slides back and forth to efficiently exhaust gas and odors of food generated from an oven range positioned below the wall-mounted type microwave oven.

2. Description of the Related Art

FIG. 1 shows a conventional wall-mounted type microwave oven 1 installed over an oven range 2. Generally, the wall-mounted type microwave oven 1 is installed over the oven range 2 and exhausts gas, fumes and odors of food generated from the oven range 2 to the outside. The wall-mounted type microwave oven 1 also serves as a cooking apparatus which cooks food therein using high-frequency electromagnetic waves.

The oven range 2 is provided at its top with a plurality of top burners 3 to cook food, for example, by combustion of gas. The wall-mounted type microwave oven 1 is adapted to cook food in a cooking chamber (not shown) by an intermolecular frictional heat which is generated by repeatedly agitating water molecules of the food with high-frequency electromagnetic wave energy generated from a magnetron (not shown).

FIG. 2 schematically shows an internal configuration of the conventional wall-mounted type microwave oven 1. The wall-mounted type microwave oven 1 includes an exhaust path 13 to exhaust gas and odors generated from food to the outside, and a cooking chamber 11 and an electrical component compartment 12 which are isolated from each other in an oven body 10.

The cooking chamber 11 and the electrical component compartment 12 are provided at their bottoms, sides and tops with the exhaust path 13 to exhaust the gas and fumes generated from the oven range 2 (see FIG. 1) disposed below the wall-mounted type microwave oven 1. The oven body 10 is provided at an upper portion of its back with an exhaust fan 14 which sucks in the gas and fumes introduced into the exhaust path 13 and discharges them to the outside. The exhaust path 13 constitutes a flow path isolated from the cooking chamber 11 and the electrical component compartment 12.

The electrical component compartment 12 includes a cooling fan 15 which cools electrical components disposed in the electrical component compartment 12. The electrical component compartment 12 is further provided at an upper portion of its front face with a front air inlet 16, which allows outside air to be introduced into the electrical component compartment 12 therethrough by operation of the cooling fan 15. A partition plate 17 which is located between the cooking chamber 11 and the electrical component compartment 12 is formed with a plurality of vent holes 18, so as to introduce air sucked into the electrical component compartment 12 into the cooking chamber 11 therethrough to ventilate the cooking chamber 11. The cooking chamber 11 is formed with a plurality of vent holes 19 at its upper surface and on the side opposite to the partition plate 17 to allow the air in the cooking chamber 11 to be discharged to the outside therethrough. The cooking chamber 11 is also provided with a front air outlet 20 which allows the air passing through the vent holes 19 to be discharged to the outside therethrough.

However, the conventional wall-mounted type microwave oven 1 cannot efficiently suck in the exhaust gas, fumes and odors generated from the oven range 2 disposed below the wall-mounted type microwave oven 1. More specifically, as shown in FIG. 1, top burners 3 of the oven range 2 are arranged in two rows, i.e., a front row of top burners 3*a* and a rear row of top burners 3*b*. Yet, the conventional wall-mounted type microwave oven 1, which is disposed over the oven range 2, is sized to cover only the rear row of top burners 3*b*. Accordingly, the wall-mounted type microwave oven 1 cannot efficiently suck in the exhaust gas, fumes and odors generated from the front row of top burners 3*a* using the exhaust fan 14 of FIG. 2. Hence, the exhaust gas, fumes and odors generated from the front row of top burners 3*a* cannot be sufficiently discharged to the outside, thereby causing room air to be contaminated.

If a suction force of the exhaust fan 14 is increased to solve the above problem, an internal configuration of the wall-mounted type microwave oven 1 must be modified due to the enlargement of the exhaust fan 14, and noise generated during rotation of the exhaust fan 14 is also undesirably intensified.

SUMMARY OF THE INVENTION

Accordingly, it is an object of the present invention to provide a wall-mounted type microwave oven which is capable of efficiently sucking in and discharging exhaust gas and odors of food generated from an oven range disposed below the wall-mounted type microwave oven.

Additional objects and advantages of the invention will be set forth in part in the description which follows and, in part, will be obvious from the description, or may be learned by practice of the invention.

To achieve the above and other objects of the present invention, there is provided a wall-mounted type microwave oven comprising an oven body which defines an exterior appearance of the microwave oven, an intake port which is provided at a bottom panel of the oven body and allows exhaust gas to be introduced into the oven body therethrough, a main exhaust fan internally provided at an upper portion of the oven body, a main exhaust path which communicates with the intake port and the main exhaust fan, and a slide duct which is provided under the oven body, and retractably extends forward to guide the exhaust gas generated from an area positioned below the oven body.

The slide duct may comprise a lower plate, side plates which are upwardly extended from corresponding sides of the lower plate, and a front plate which is upwardly extended from a front end of the lower plate so as to define an auxiliary exhaust path, which guides the exhaust gas toward the main exhaust path, between the bottom panel of the oven body and the lower plate of the slide duct.

The slide duct may be further provided with an upper plate connected to upper ends of the side plates and the front plate, and the upper and lower plates may include a through port which communicates with the intake port of the bottom panel of the oven body where the slide duct is retracted into the oven body.

The slide duct may further include an auxiliary exhaust fan which is provided at an internal front portion of the slide duct, and sucks in the exhaust gas generated from a region below the slide duct where the slide duct is extended forward, and guide plates which accommodate the auxiliary exhaust fan and extend toward the oven body to guide the exhaust gas introduced by the auxiliary exhaust fan toward the main exhaust path of the oven body.

The side plates of the slide duct may include corresponding rails which extend longitudinally along the side plates, and the oven body may include side panels having corresponding slide grooves, along which the rails of the slide duct are slidably moved back and forth.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
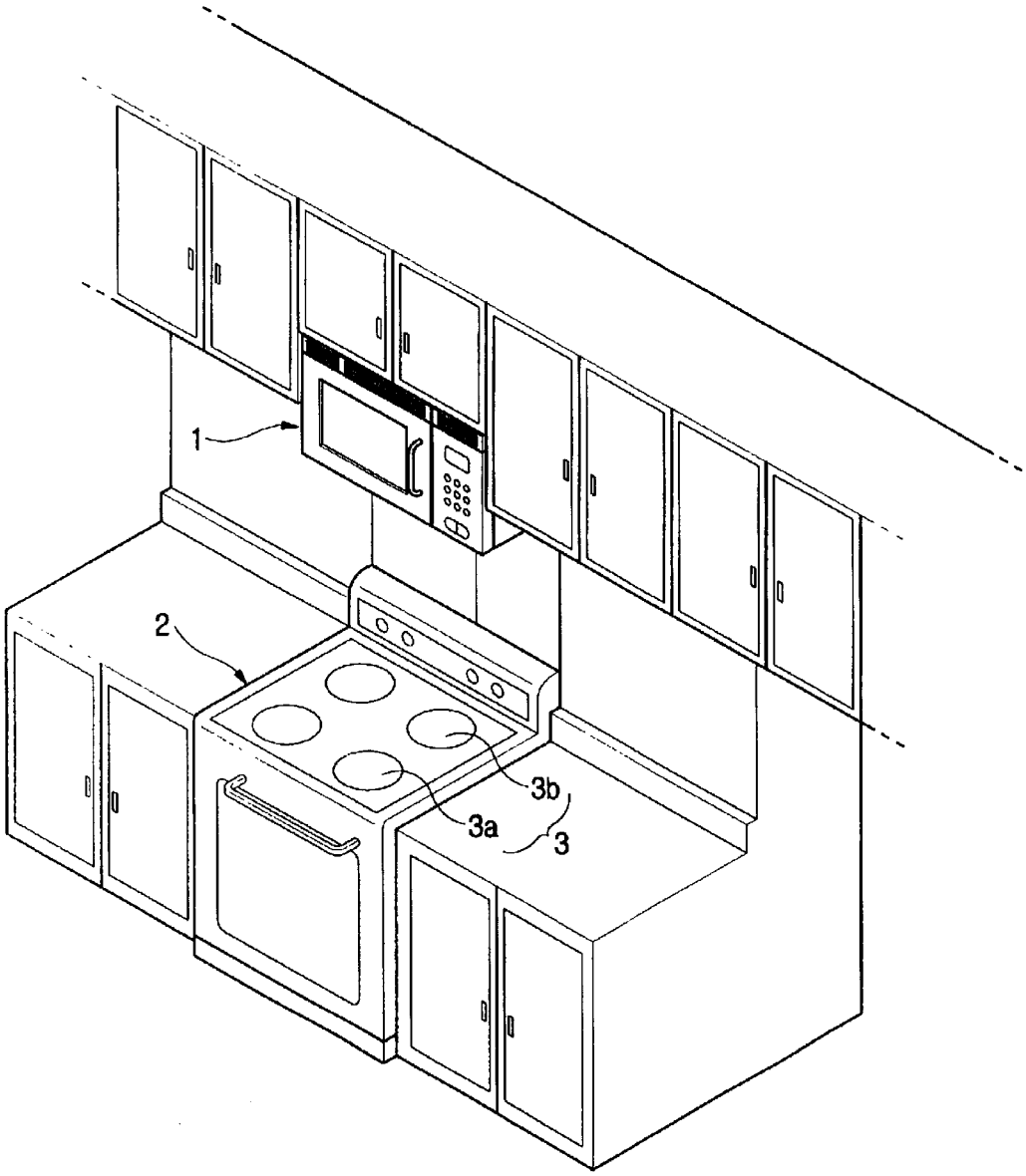
FIG. 1 (PRIOR ART)
FIG. 1 is a perspective view of a conventional wall-mounted type microwave oven, which is installed above an oven range.
Figure 2:
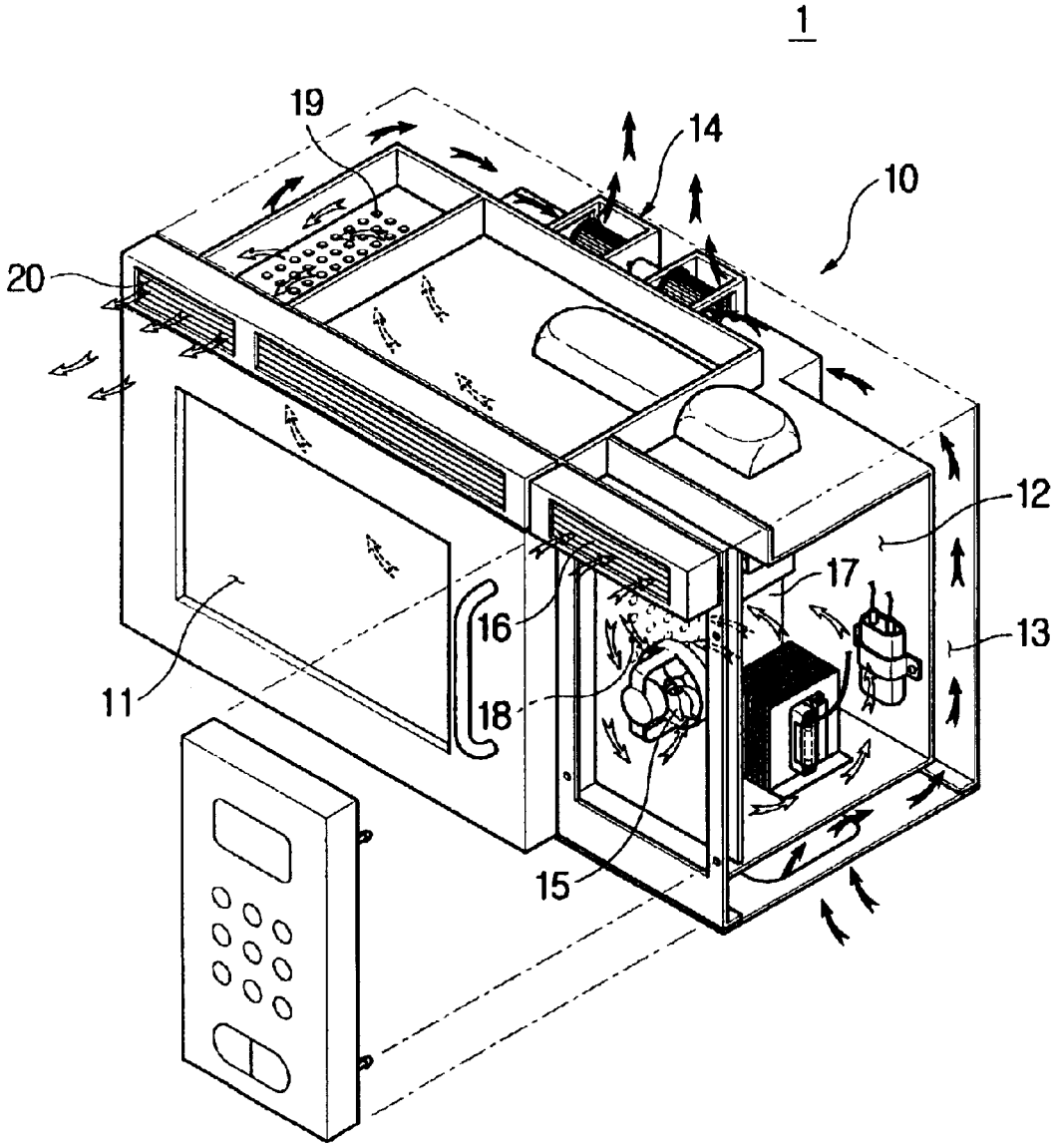
FIG. 2 (PRIOR ART)
FIG. 2 is a perspective view of the conventional wall-mounted type microwave oven having an exhaust path which guides exhaust gas generated from the oven range.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
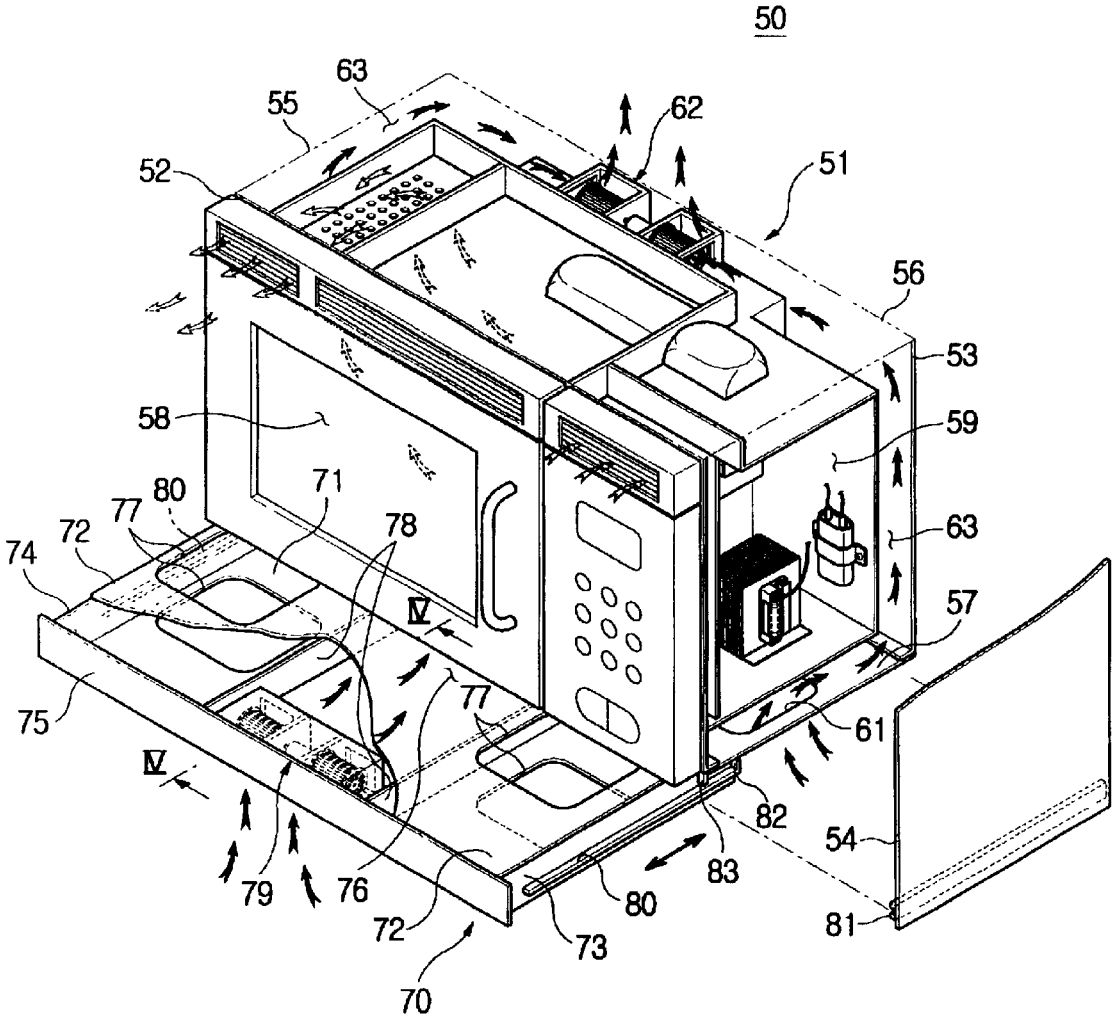
FIG. 3 is a perspective view of a wall-mounted type microwave oven according to an embodiment of the present invention, in which a slide duct is extended forward therefrom.
Figure 4:
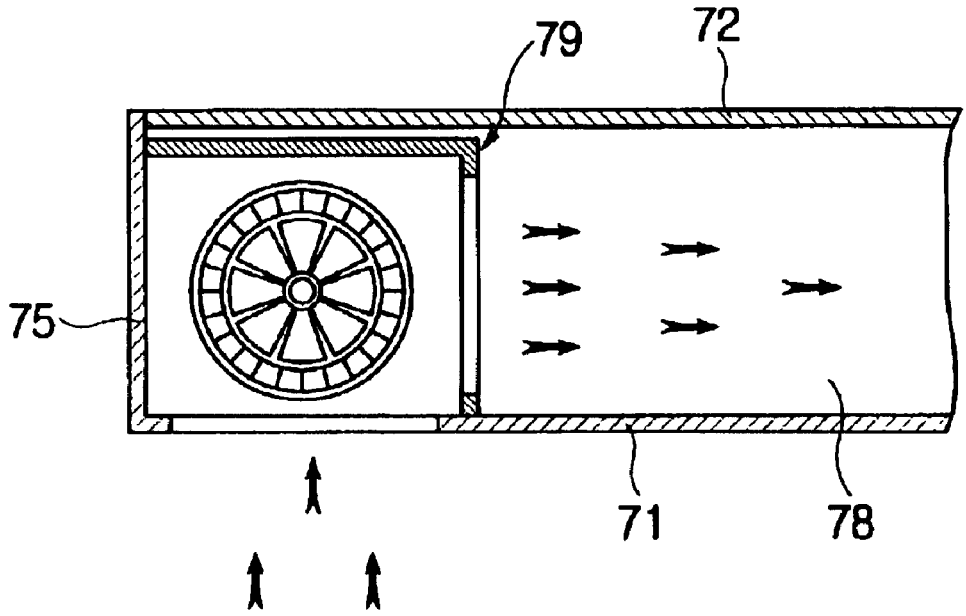
FIG. 4 is a cross-sectional view taken along line IV—IV of FIG. 3.

FIG. 3 shows a wall-mounted type microwave oven 50 according to an embodiment of the present invention, in which a slide duct 70 is extended forward therefrom. FIG. 4 shows a cross-sectional view taken along line IV—IV of FIG. 3, and illustrates an exhaust path of the slide duct 70.

As shown in FIG. 3, the wall-mounted type microwave oven 50 includes a box-shaped oven body 51 having front and rear panels 52 and 53, side panels 54 and 55, and top and bottom panels 56 and 57. The oven body 51 includes a cooking chamber 58 to receive food therein, and an electrical component compartment 59 which is isolated from the cooking chamber 58 and outputs high-frequency electromagnetic waves to cook the food.

The bottom plate 57 includes intake ports 61 which allow exhaust gas and odors generated from an oven range 2 (see FIG. 6) to be introduced into the oven body 51 therethrough. The oven body 51 further includes a main exhaust fan 62 which is provided at an upper back portion thereof. The main exhaust fan 62 sucks in the exhaust gas and discharges it to the outside. An exhaust path 63 is disposed between the intake ports 61 and the main exhaust fan 62, and is adapted to guide the exhaust gas introduced through the intake ports 61 toward the main exhaust fan 62. The exhaust path 63 includes a space defined between the cooking chamber 58 and the electric component compartment 59, and both the side panels 54 and 55, the bottom panel 57 and the rear panel 53 of the oven body 51.

The slide duct 70 comprises upper and lower plates 72 and 71 which are of a size approximately equal to a size of the bottom panel 57 of the oven body 51, side plates 73 and 74 connected between corresponding sides of the upper and lower plates 72 and 71, and a front plate 75 connected between front sides of the upper and lower plates 72 and 71.

The upper and lower plates 72 and 71 of the slide duct 70 include corresponding through ports 77 which communicate with the intake ports 61 of the bottom panel 57 of the oven body 51, so as to allow the exhaust gas to be introduced into the intake ports 61 via the through ports 77 where the slide duct 70 is retracted into the oven body 51.

The slide duct 70 further comprises an auxiliary exhaust fan unit 79 which is provided at an internal front portion thereof, and directs the exhaust gas to the main exhaust fan 62 where, for example, the slide duct 70 is extended forward. The auxiliary exhaust fan unit 79 is opened at its lower and side surfaces, and permits the exhaust gas to be introduced into the oven body 51 therethrough.

The auxiliary exhaust fan unit 79 is designed to have a blowing capacity smaller than that of the main exhaust fan 62 so as to have the exhaust gas be sucked and directed toward the main exhaust fan 62.

While the slide duct 70 is described with the upper and lower plates 72 and 71, the side plates 73 and 74, and the front plate 75, the exhaust gas can be directed to the oven body 51 by the auxiliary exhaust fan unit 79 without the upper plate 72.

Referring back to FIG. 3, the slide duct 70 is provided therein with a pair of guide plates 78, which extend toward the oven body from both sides of the auxiliary exhaust fan unit 79 and guide the exhaust gas introduced by the auxiliary exhaust fan unit 79 toward the bottom plate 57 of the oven body 51. Since the slide duct 70 is provided therein with an auxiliary exhaust path 76 by the pair of guide plates 78, the exhaust gas introduced by the auxiliary exhaust fan unit 79 can be guided to the intake port 61 of the oven body 51 without passing through the through ports 77.

The side plates 73 and 74 of the slide duct 70 are provided at their outer surfaces with rails 80, which extend longitudinally along the side plates 73 and 74, and the side panels 54 and 55 of the oven body 51 are provided at lower ends of their inner surfaces with corresponding slide grooves 81, in which the rails 80 of the side plates 73 and 74 are slidably inserted. The rails 80 are provided at their rear ends with corresponding stop pieces 82 which extend upward. The front panel 52 is provided at both sides of its lower end with stoppers 83 which extend downward, so as to prevent separation of the slide duct 70 from the oven body 51.

An operation of the wall-mounted type microwave oven 50 according to the present will be described below with reference to FIGS. 3 to 6.

Figure 6:
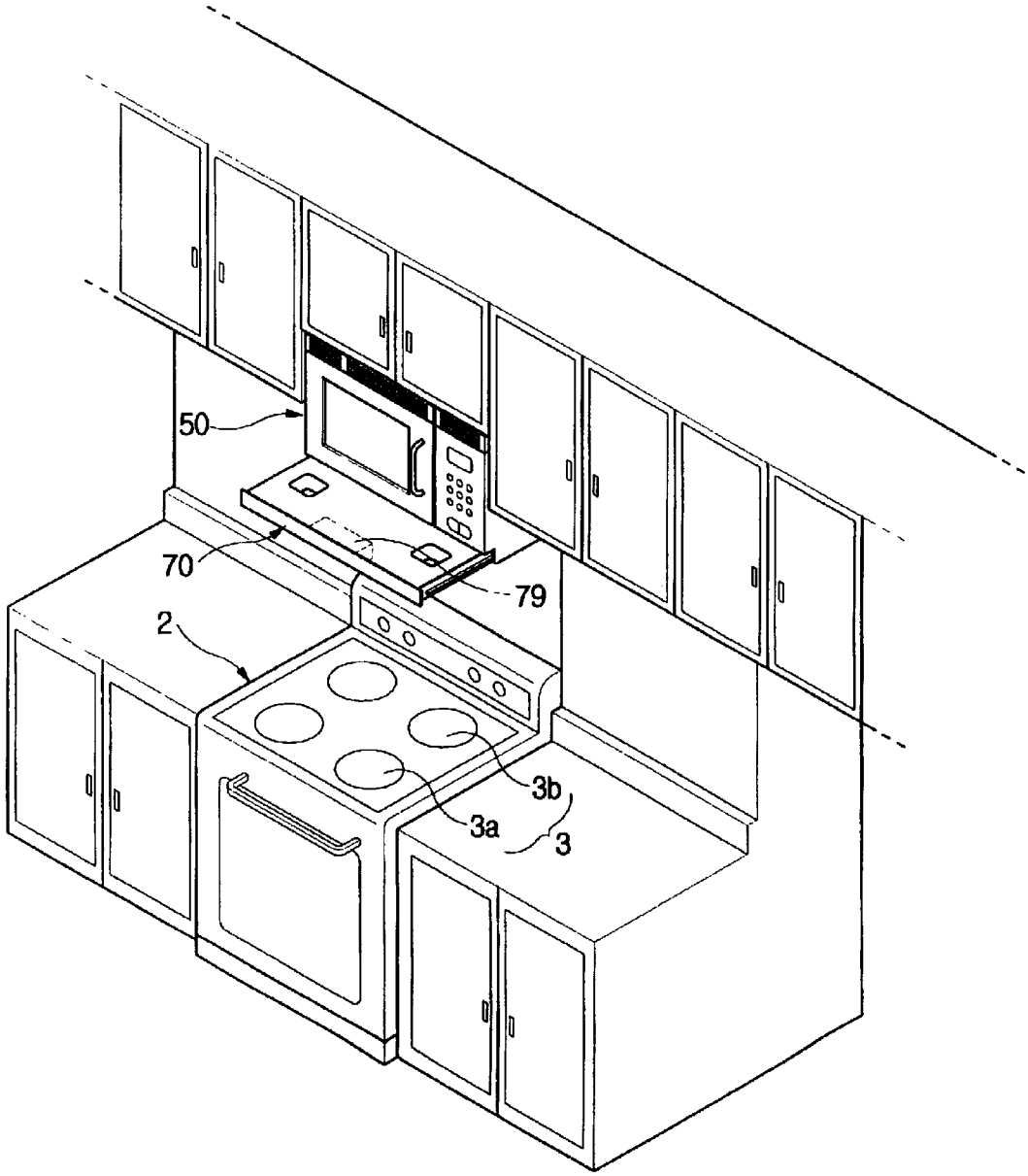
FIG. 6 is a perspective view of the wall-mounted type microwave oven of the present invention, which is installed above an oven range, with the slide duct being extended forward therefrom.

FIG. 6 shows the wall-mounted type microwave oven 50 according to the present invention, in which the slide duct 70 is slidably extended forward to efficiently suck exhaust gas generated from a front row of top burners 3*a*, or both front and rear rows of top burners 3*a* and 3*b* of an oven range 2 disposed below the wall-mounted type microwave oven 50.

As shown in FIGS. 3 and 4, with reference to FIG. 6, where the slide duct 70 is extended forward from the oven body 51, the stop pieces 82 fixed to the rear ends of the rails 80 of the slide duct 70 are caught by the stoppers 83 provided at the lower end of the front panel 52 of the oven body 51, and the slide duct 70 is positioned above the front row of top burners 3*a* of the oven range 2. Where the forward extension of the slide duct 70 is completed, the main exhaust fan 62 and the auxiliary exhaust fan 79 are operated concurrently.

By the operation of the main exhaust fan 62, exhaust gas and odors of food generated from the rear row of top burners 3b are largely introduced through the intake ports 61 formed at the bottom panel 57 of the oven body 51 and discharged to the outside via the exhaust path 63. At the same time, by the operation of the auxiliary exhaust fan 79, exhaust gas and odors of food generated from the front row of top burners 3*a* are introduced into the auxiliary exhaust path 76 of the slide duct 70, directed to the main exhaust path 63, and added to the exhaust gas and odors generated from the rear row of top burners 3*b*. Thereafter, the mixed exhaust gas and orders are discharged to the outside by the main exhaust fan 62.

Figure 5:
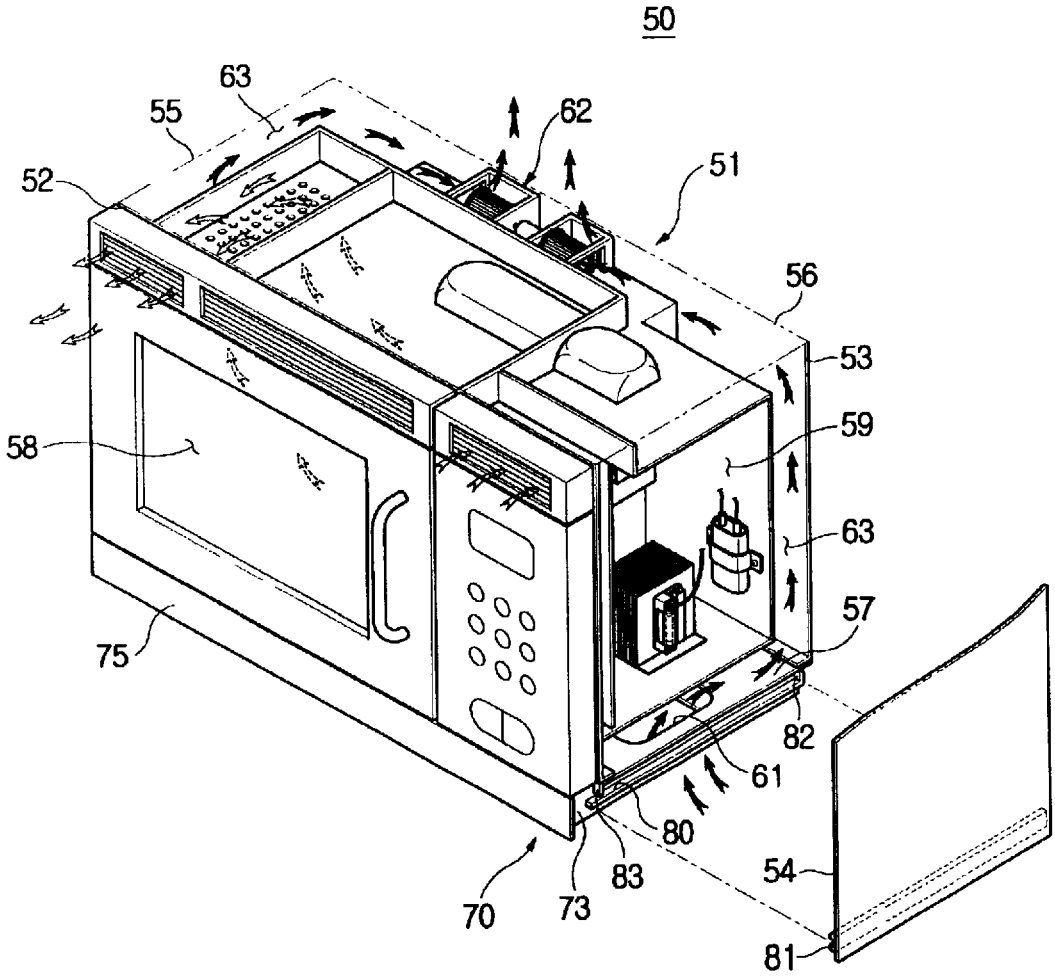
FIG. 5 is a perspective view of the wall-mounted type microwave oven as shown in FIG. 3, in which the slide duct is retracted into the wall-mounted type microwave oven.

When it is not necessary to use the slide duct 70, because only the rear row of top burners 3*b* of the oven range 2 are operated, the slide duct 70 can be retracted into the oven body 51, as shown in FIG. 5. At this point, by the operation of the main exhaust fan 62, exhaust gas and odors of food generated from the rear row of top burners 3*b* are introduced into the exhaust path 63 via the through ports 77 of the slide duct 70 and the intake ports 61 of the bottom panel 57 and discharged to the outside.

As described above, the present invention provides a wall-mounted type microwave oven having a slide duct which slidably extends forward to efficiently exhaust gas generated from an oven range occupying a larger area than that of the wall-mounted type microwave oven. Accordingly, the exhaust gas is sufficiently discharged to the outside, and an odorless cooking environment is maintained.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A wall-mounted type microwave oven, comprising:

an oven body which defines an exterior appearance of the microwave oven;

an intake port which is provided at a bottom panel of the oven body, and allows exhaust gas to be introduced into the oven body therethrough;

a main exhaust fan internally provided at an upper portion of the oven body;

a main exhaust path which communicates with the intake port and the main exhaust fan; and a slide duct which is provided under the oven body, and retractably extends forward to guide the exhaust gas generated from an area positioned below the oven body, wherein the slide duct comprises:

a lower plate, side plates upwardly extended from corresponding sides of the lower plate, a front plate upwardly extended from a front end of the lower plate so as to define an auxiliary exhaust path, which guides the exhaust gas toward the main exhaust path, between the bottom panel of the oven body and the lower plate of the slide duct, an upper plate connected to upper ends of the side plates and the front plate, and an auxiliary exhaust fan which is provided at an internal front portion of the slide duct, and sucks in the exhaust gas generated from a region below the slide duct where the slide duct is extended forward.

2. The wall-mounted type microwave oven of claim 1, wherein the slide duct further comprises guide plates which accommodate the auxiliary exhaust fan and extend toward the oven body to guide the exhaust gas introduced by the auxiliary exhaust fan toward the main exhaust path of the oven body.

3. A wall-mounted type microwave oven, comprising:

an oven body which defines an exterior appearance of the microwave oven;

an intake port which is provided at a bottom panel of the oven body, and allows exhaust gas to be introduced into the oven body therethrough;

a main exhaust fan internally provided at an upper portion of the oven body;

a main exhaust path which communicates with the intake port and the main exhaust fan; and a slide duct which is provided under the oven body, and retractably extends forward to guide the exhaust gas generated from an area positioned below the oven body, wherein the slide duct comprises:

a lower plate, side plates upwardly extended from corresponding sides of the lower plate, a front plate upwardly extended from a front end of the lower plate so as to define an auxiliary exhaust path, which guides the exhaust gas toward the main exhaust path, between the bottom panel of the oven body and the lower plate of the slide duct, wherein:

the side plates of the slide duct include corresponding rails which extend longitudinally along the side plates, the oven body includes side panels having corresponding slide grooves, along which the rails of the slide duct are slidably moved back and forth, the rails include corresponding stop pieces which are provided at rear ends of the rails and extend upward, and the oven body further includes a front panel having stoppers which are provided at a lower end of the front panel, and extend downward to catch the corresponding stop pieces of the rails.

4. A wall-mounted type microwave oven, comprising:

an oven body which defines an exterior appearance of the microwave oven;

an intake port which is provided at a bottom panel of the oven body, and allows exhaust gas to be introduced into the oven body therethrough;

a main exhaust fan internally provided at an upper portion of the oven body;

a main exhaust path which communicates with the intake port and the main exhaust fan; and a slide duct which is provided under the oven body, and retractably extends forward to guide the exhaust gas generated from an area positioned below the oven body, wherein:

the slide duct includes an auxiliary exhaust fan which directs the exhaust gas generated from a region below the slide duct toward the intake port, and the main exhaust fan and the auxiliary exhaust fan operate concurrently in response to the slide duct being extended forward.

5. A wall-mountable cooking apparatus, comprising:

an oven body which defines an outer appearance of the cooking apparatus;

a cooking chamber to receive food therein;

a heating unit which cooks the food;

a main exhaust path provided in the oven body;

an intake port which introduces exhaust gas below the oven body into the main exhaust path;

a main exhaust fan which communicates with the main exhaust path and discharges the exhaust gas to a desired location; and a slide duct which retractably extends from the oven body and guides the exhaust gas below the slide duct toward the intake port, wherein the slide duct includes an auxiliary exhaust fan which directs the exhaust gas below the slide duct toward the intake port.

6. The cooking apparatus of claim 5, wherein the slide duct further includes an auxiliary exhaust path which communicates with the auxiliary exhaust fan and guides the exhaust gas toward the intake port.

7. The cooking apparatus of claim 6, wherein the main exhaust fan and the auxiliary exhaust fan operates concurrently in response to the slide duct being extended forward.

* * * * *